US005902157A

United States Patent [19]

Boris

[11] Patent Number: 5,902,157

[45] Date of Patent: May 11, 1999

[54] RUDDER ATTACHMENT FOR TROLLING MOTOR

[76] Inventor: Donald R. Boris, 5301 Azie Ave., Fort Worth, Tex. 76114

[21] Appl. No.: 09/095,914

[22] Filed: Jun. 11, 1998

[51] Int. Cl.[6] ..... B63H 25/42

[52] U.S. Cl. ..... 440/51; 440/6

[58] Field of Search ..... 440/6, 51; 114/146, 114/152, 162, 164, 165, 168

[56] References Cited

U.S. PATENT DOCUMENTS

| | | | |
|---|---|---|---|
| 4,290,760 | 9/1981 | Lindblad | 440/51 |
| 4,634,388 | 1/1987 | Covell | 440/51 |
| 4,944,702 | 7/1990 | Cain | 440/51 |

FOREIGN PATENT DOCUMENTS

| | | | |
|---|---|---|---|
| 1257812 | 7/1989 | Canada | 440/71 |

*Primary Examiner*—Jesus D. Sotelo
*Attorney, Agent, or Firm*—James E. Bradley

[57] ABSTRACT

An electric trolling motor has a motor body with a propeller, and a vertical shaft extending upward from the motor body. A rudder attachment having forward, rearward and lower portions is secured to the motor. The forward portion is a diagonal blade located between the shaft and a forward end of the body. The rearward portion is a thin rudder which extends between a rearward end of the motor body and the shaft. The lower portion has is mounted to a lower side of the motor body and tapers downward. Tie wraps are used to securely fasten the portions of the rudder attachment to each other and to the trolling motor.

18 Claims, 1 Drawing Sheet

RUDDER ATTACHMENT FOR TROLLING MOTOR

TECHNICAL FIELD

This invention relates in general to trolling motors and in particular to an attachment for a trolling motor.

BACKGROUND ART

Trolling motors for fishing boats are well known in the art and have been used by fishermen for many years. A typical trolling motor is a small, very low power insulated electric motor body which is mounted on the lower end of a hollow shaft. The electric motor drives a rotatable propeller at the rearward end of the motor body. Electrical wires extend through the shaft to supply power to the motor. The shaft is clamped to a side edge of the boat and is usually pivotable between vertical and horizontal positions. During use, the shaft is vertically aligned so that the motor body is submerged beneath the water. When the trolling motor is not in use, the shaft is pivoted to the horizontal position, parallel to the water so that the motor body is out of the water. Typically, trolling motors are used only in an auxiliary capacity to slowly and quietly maneuver the boat over short distances.

One problem with prior art trolling motors is their diminished capacity to steer the boat at their inherent low speeds. This is due to the small size and shape of the submerged portions of the trolling motor. Although some trolling motors have small fins or rudders, prior art designs lack the ability to adequately steer the boat when precise maneuvers are desired. Boaters are often required to oversteer or accentuate the desired direction of the boat in order to compensate for the lack of steerability. An improved apparatus or method of steering a boat with a trolling motor is needed.

DISCLOSURE OF THE INVENTION

An electric trolling motor has a motor body with a propeller, and a vertical shaft extending upward from the motor body. A rudder attachment having forward, rearward and lower portions is secured to the motor. The forward portion is a diagonal blade located between the shaft and a forward end of the body. The rearward portion is a thin rudder which extends between a rearward end of the motor body and the shaft. The lower portion has is mounted to a lower side of the motor body and tapers downward. Tie wraps are used to securely fasten the portions of the rudder attachment to each other and to the trolling motor.

BEST MODE FOR CARRYING OUT THE INVENTION

Figure 1:
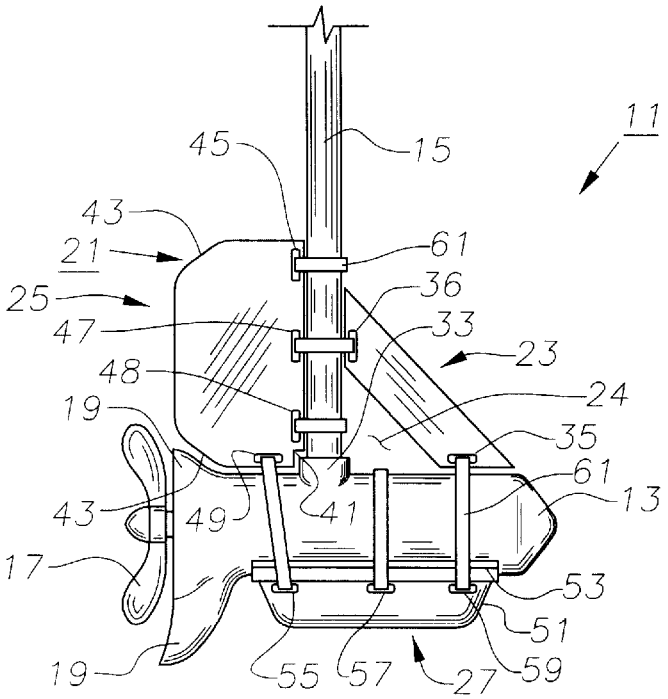
FIG. 1 is a side view of a trolling motor constructed in accordance with the invention.
Figure 2:
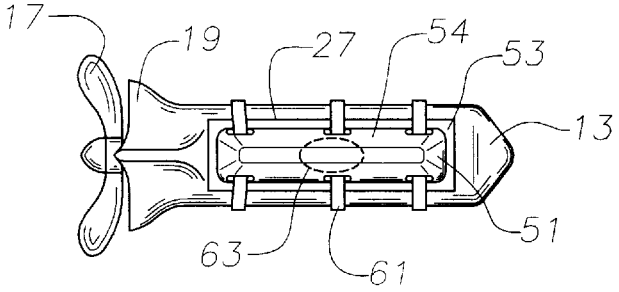
FIG. 2 is a bottom view of the trolling motor of FIG. 1.
Figure 3:
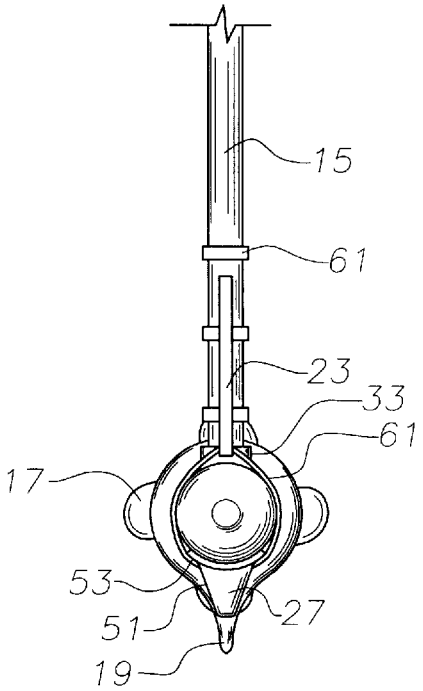
FIG. 3 is a front view of the trolling motor of FIG. 1.

Referring to FIGS. 1–3, a conventional electric trolling motor 11 having a generally cylindrical, hydrodynamic body 13, a vertical shaft 15, a propeller 17 and flared propeller guards 19 is shown. Propeller guards 19 are optional and help prevent propeller 17 from becoming entangled in aquatic vegetation while acting in a limited capacity as a rudder for a fishing boat (not shown).

A rudder attachment 21 comprising a forward portion 23, a rearward portion 25 and a lower portion 27 is secured to trolling motor 11. In the preferred embodiment, portions 23, 25 and 27 are fabricated from rigid plastic. Forward portion 23 is a thin diagonal blade and is located on forward and upper sides of shaft 15 and body 13, respectively, and is provided to prevent shaft 15 from becoming entangled in aquatic vegetation. Forward portion 23 is of constant width and inclines upward and rearward from a forward end of body 13 to shaft 15. Forward portion 23 is approximately half the length of body 13' and is centered on trolling motor 11 along a vertical plane defined by body 13 and shaft 15. A triangular open space 24 is located between shaft 15 and the lower edge of forward portion 23. Small rectangular slots 35 and 36 are located along the lower forward and rearward edges, respectively, of forward portion 23.

Rearward portion 25 is a thin, generally rectangular rudder and is vertically disposed along rearward and upper sides of shaft 15 and body 13, respectively. Alternatively, if the upper side of body 13 is longer (not shown), rearward portion 25 will be horizontally disposed with a length that is greater than its height. In one embodiment, the rearward edge of rearward portion 25 is flush with the rearward edge of propeller guards 19, and rearward portion 25 has a height that is approximately equal to the length of forward portion 23. Rearward portion 25 is also located in the same plane defined by forward portion 23. In the embodiment shown, rearward portion 25 has a small notch 41 on a lower, forward corner for accommodating hub 33. The two rearward corners 43 of rearward portion 25 are clipped diagonally at approximately 45 degrees. Rearward portion 25 has three small, spaced apart rectangular slots 45, 47, 48 located along a forward edge and one slot 49 along a lower edge. Slots 45, 47, 48 and 49 are identical to slots 35, 36.

Lower portion 27 has a generally rectangular body 51 that is integrally formed with a semi-cylindrical upper flange 53. Body 51 tapers downward away from body 13 and coincides with the plane defined by portions 23, 25. Body 51 has a shallow rectangular cavity 54 that faces downward. Flange 53 extends from a forward end of body 13 to propeller guards 19 and is contoured to follow the shape of the lower side of body 13. Three slots 55, 57, 59 are located near the interface between body 51 and flange 53, and are identical to slot 35. As indicated schematically in FIG. 2, a small depth transducer 63 may be located within cavity 54 in body 51. The surrounding walls of body 51 provide protection for transducer 63 as a transducer guard.

A plurality of hose clamps or tie wraps 61 are used to securely fasten the rectangular slots of rudder attachment 21 to each other and to trolling motor 11. Tie wraps 61 have an adjustable length prior to installation and are trimmed to size after being installed. The forwardmost tie wrap 61 is wrapped around body 13 to join the slots 35 and 59. Slot 55 is similarly joined to slot 49. Slot 57 is tie wrapped directly to body 13. Slot 45 is directly fastened to shaft 15 above an upper end of forward portion 23. Slot 36 is tie wrapped to slot 47 around shaft 15. Alteratively, if forward portion 23 is longer or intersects shaft 15 at a higher point (not shown), slot 36 may be tie wrapped to slot 45 or directly to shaft 15. Slot 48 is directly fastened to shaft 15. With tie wraps 61 in place, rudder attachment 21 is restricted to very limited motion relative to trolling motor 11. In an alternate embodiment (not shown), rudder attachment 27 may comprise a boot which completely encapsulates body 13 and the lower end of shaft 15.

The invention has several advantages. The rudder attachment is easily attached to conventional trolling motors and enhances the precision and steerability of the trolling motor at low speeds. The shape of the rudder attachment also reduces the probability of propeller entanglement with aquatic vegetation.

While the invention has been shown or described in only some of its forms, it should be apparent to those skilled in the art that it is not so limited, but is susceptible to various changes without departing from the scope of the invention.

I claim:

1. An apparatus for attachment to a trolling motor having a generally horizontal body and a vertical shaft extending upward from the body, comprising:

a first portion which is adapted to be secured to one end of the body on a first side of the vertical shaft;

a second portion which is adapted to be secured to an opposite end of the body on a second side of the vertical shaft; and wherein the first and second portions combine to form a rudder attachment on the trolling motor for enhancing the steering capability of the trolling motor.

2. The apparatus of claim 1 wherein each of the first and second portions are formed from rigid plastic.

3. The apparatus of claim 1 wherein the first and second portions are aligned in a vertical plane which vertically bisects the trolling motor.

4. The apparatus of claim 1 wherein the first portion comprises a thin diagonal blade.

5. The apparatus of claim 1 wherein each of the first and second portions have small slots which receive fasteners for attaching the first and second portions to the trolling motor.

6. The apparatus of claim 1 wherein the second portion is a thin, generally rectangular rudder.

7. The apparatus of claim 1 wherein a rearward edge of the second portion is flush with a rearward edge of the trolling motor.

8. The apparatus of claim 1, further comprising a third portion which is adapted to be secured to a lower side of the body.

9. Tee apparatus of claim 8 wherein the third portion is generally rectangular and tapers downward from the body and coincide with a vertical plane defined by the first and second portions.

10. The apparatus of claim 9 wherein the third portion has a flange which is adapted to be contoured to a lower side of the body.

11. The apparatus of claim 1, further comprising a depth transducer.

12. The apparatus of claim 1, further comprising fasteners for attaching the first and second portions to the trolling motor.

13. An apparatus, comprising:

a trolling motor having a generally horizontal body with a propeller on a rearward end, and a vertical shaft extending upward from the body;

a forward portion mounted between a forward end of the body and the vertical shaft;

a rearward portion mounted between a rearward end of the body and the vertical shaft; and a lower portion mounted adjacent to a lower surface of the body; and wherein the forward, rearward and lower portions are aligned in a vertical plane which bisects the trolling motor and combine to form a rudder attachment on the trolling motor for enhancing the steering capability of the trolling motor.

14. The apparatus of claim 13 wherein each of the forward, rearward and lower portions are formed from rigid plastic.

15. The apparatus of claim 13 wherein the forward portion comprises a diagonal blade, the rearward portion is a generally rectangular rudder, and the lower portion is generally rectangular and affixed to a flange which tapers downward from the body.

16. The apparatus of claim 13 wherein each of the forward, rearward and lower portions have slots which receive fasteners for attaching the forward, rearward and lower portions to the trolling motor.

17. The apparatus of claim 13 further comprising a depth transducer.

18. The apparatus of claim 13, further comprising fasteners for attaching the forward, rearward and lower portions to the trolling motor.

* * * * *